US006201381B1

(12) United States Patent
Yasuda

(10) Patent No.: US 6,201,381 B1
(45) Date of Patent: Mar. 13, 2001

(54) REFERENCE VOLTAGE GENERATING CIRCUIT WITH CONTROLLABLE LINEAR TEMPERATURE COEFFICIENT

(75) Inventor: Yukio Yasuda, Itami (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 697 days.

(21) Appl. No.: 08/543,933

(22) Filed: Oct. 17, 1995

(30) Foreign Application Priority Data

Mar. 29, 1995 (JP) ..... 7-071779

(51) Int. Cl.[7] ..... G05F 3/16; G05F 3/20
(52) U.S. Cl. ..... 323/315; 327/540
(58) Field of Search ..... 323/313, 314, 323/315, 316; 327/513, 540, 512

(56) References Cited

U.S. PATENT DOCUMENTS 4,990,846 * 2/1991 Buck et al. ..... 323/314
5,327,028 * 7/1994 Yum et al. ..... 323/313
5,352,973 * 10/1994 Audy ..... 323/313
5,430,395 * 7/1995 Ichimaru ..... 327/312

* cited by examiner

*Primary Examiner*—Peter S. Wong
*Assistant Examiner*—Bao Q. Vu
(74) *Attorney, Agent, or Firm*—Leydig, Voit & Mayer, Ltd

(57) ABSTRACT

A voltage divider circuit is connected between the output terminals of a constant-voltage power supply outputting a constant voltage. A constant-current source varies linearly, relative to temperature, the current level flowing to or from the voltage divider junction of the voltage divider circuit. The constant-current source comprises a first transistor and a second transistor connected to a current mirror circuit, and a resistor connected between the ground and the emitter of the second transistor. The base of the current extracting transistor is connected to the bases of the first transistor and the second transistor, and the collector and emitter are connected between the respective voltage divider junction and ground to obtain a current from the voltage divider junction. A current proportional to temperatures and inversely proportional to the value of the resistor can thereby be obtained from the voltage divider junction.

12 Claims, 6 Drawing Sheets

REFERENCE VOLTAGE GENERATING CIRCUIT WITH CONTROLLABLE LINEAR TEMPERATURE COEFFICIENT

BACKGROUND OF THE INVENTION

1. Field of the Invention

The present invention relates to a reference voltage generator in a charging device.

2. Description of Related Art

Charging devices for charging batteries generally comprise an internal reference voltage generator for comparing the battery voltage with the reference voltage output by the reference voltage generating circuit, and controlling battery charging according to the detected voltage difference. Because the optimum charging voltage of the battery varies according to the temperature, the reference voltage generating circuit is built with output temperature characteristics matching the battery characteristics to achieve optimum control in charging devices that maintain a constant correlation between the ambient temperature and battery.

An example of a reference voltage generating circuit known in the prior art is shown in FIG. 1. This reference voltage generating circuit comprises resistors $R_{51}$ and $R_{52}$, n (where n is an integer) diodes $D_1$~$D_n$, and resistors $R_{53}$ connected in series in this order between the constant-voltage power supply 1, which outputs a voltage with little temperature-dependent variation, and ground, and outputs the reference voltage $V_0$ from between the ground and the output terminal 3 connected to the junction point between resistor $R_{51}$ and resistor $R_{52}$.

The reference voltage $V_0$ can be expressed by Equation (1) where the voltage of the constant-voltage power supply 1 is $V_{cc}$, the forward voltage of diodes $D_1$~$D_n$ is $V_F$, and the current flowing through resistors $R_{51}$ and $R_{52}$, n (where n is an integer) diodes $D_1$~$D_n$, and resistor $R_{53}$ is $I_{50}$.

$$V_0=V_{cc}-I_{50}\times R_{51}$$
$$=(R_{52}+R_{53})V_{cc}/(R_{51}+R_{52}+R_{53})+n\ R_{51}V_F/(R_{51}+R_{52}+R_{53})[V] \quad (1)$$

The temperature characteristic $\partial V_0/\partial T$ of the reference voltage $V_0$ to the absolute temperature T can be expressed by Equation (2) derived from Equation (1) if it is assumed that the voltage $V_{cc}$ of the constant-voltage power supply 1 has no temperature dependence.

$$\partial V_0/\partial T=n\ R_{51}/(R_{51}+R_{52}+R_{53})\times\partial V_F/\partial T[V/^\circ C.] \quad (2)$$

From Equation (2), it is known that the temperature characteristic ($\partial V_0/\partial T$) of the reference voltage $V_0$ is determined by the n diodes $D_1$~$D_n$, resistors $R_{51}$, $R_{52}$, and $R_{53}$, and ($\partial V_F/\partial T$). From Equation (2), it is therefore possible to obtain various combinations of n diodes $D_1$~$D_n$ and resistors $R_{51}$, $R_{52}$, and $R_{53}$ if voltage $V_{cc}$ is fixed and the value of the reference voltage $V_0$ is determined, and the temperature characteristic ($\partial V_0/\partial T$) can be achieved for this number of combinations.

The number n of diodes $D_1$~$D_n$, however, is a discrete integer value. As a result, it is not possible to set any desired temperature characteristic ($\partial V_0/\partial T$) by means of the reference voltage generating circuit described above.

SUMMARY OF THE INVENTION

An object of the present invention is to provide a reference voltage generator circuit for generating a reference voltage that has a desired temperature characteristic and varies linearly relative to the temperature.

A further object of the present invention is to provide a reference voltage generating circuit for generating a reference voltage having a negative temperature coefficient.

A further object of the present invention is to provide a reference voltage generating circuit for generating a reference voltage having a positive temperature coefficient.

A further object of the present invention is to provide a reference voltage generating circuit for generating plural reference voltages each having a desired temperature characteristic and varying linearly relative to the temperature.

A further object of the present invention is to provide a reference voltage generating circuit for generating, in addition to a reference voltage that has a desired temperature characteristic and varies linearly relative to the temperature, a look-up voltage of which the temperature characteristic is zero.

A further object of the present invention is to provide a reference voltage generating circuit which can generate, by means of combination with an operational amplifier, plural reference voltages having a desired temperature characteristic and varying linearly relative to the temperature.

In a reference voltage generating circuit according to the present invention, a constant-current source of which the current level flowing into or out of a voltage divider junction varies linearly with a desired temperature coefficient is connected to the voltage divider junction of the voltage dividing circuit connected between the output terminals of a constant-voltage power supply outputting a constant voltage, thereby outputting the reference voltage from the voltage divider junction.

Preferably, the reference voltage is controlled to vary linearly with a negative temperature coefficient to the temperature.

Preferably, the constant-current source is made as an integrated circuit.

Preferably, it further comprises a current mirror circuit which controls the current flowing through the first current path and the current flowing through the second current path to be equal, a first transistor and a second transistor are respectively connected to the first current path and the second current path of the current mirror circuit, and a current inversely proportional to the value of the resistor connected to the emitter of the first transistor and proportional to the temperature is output from the voltage divider junction of the voltage dividing circuit.

Preferably, the reference voltage is controlled to vary linearly with a positive temperature coefficient to the temperature.

Preferably, it further comprises a current mirror circuit which controls the current flowing through the first current path and the current flowing through the second current path to be equal, a first transistor and a second transistor are respectively connected to the first current path and the second current path of the current mirror circuit, and a current inversely proportional to the value of the resistor connected to the emitter of the second transistor and proportional to the temperature is input to the voltage divider junction of the voltage divider circuit.

A reference voltage generating circuit according to the present invention may comprise a plurality of voltage divider circuits; a current mirror circuit controlling the current flowing through the first current path and the current flowing through the second current path to be equal; a first transistor of which the emitter is connected to the other output terminal of the constant-voltage power supply; a second transistor of which the base is connected to the base and collector of the first transistor; a first resistor connected between the emitter of the second transistor and the other output terminal of the constant-voltage power supply; a third and a fourth transistor; a fifth transistor of which the base is connected to the collector of the fourth transistor, the emitter is connected to the base of the third transistor, and the collector is connected to one of the output terminals of the constant-voltage power supply; and current extracting transistors of which each base is connected to the emitter of the fifth transistor, and each collector is connected to each voltage divider junction of the voltage divider circuits; such that a current inversely proportional to the value of the first resistor and proportional to the temperature is obtained from the voltage divider junction.

Preferably, the reference voltage generating circuit may obtain a standard voltage of which the temperature characteristic is zero from the emitter of the fifth transistor.

Preferably, the reference voltage generating circuit may connect the constant-current source and the plural sets of voltage divider circuits to the output of an operational amplifier, and connect the standard power supply output from the constant-current source to the operational amplifier.

Preferably, the constant-current source is made as an integrated circuit.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
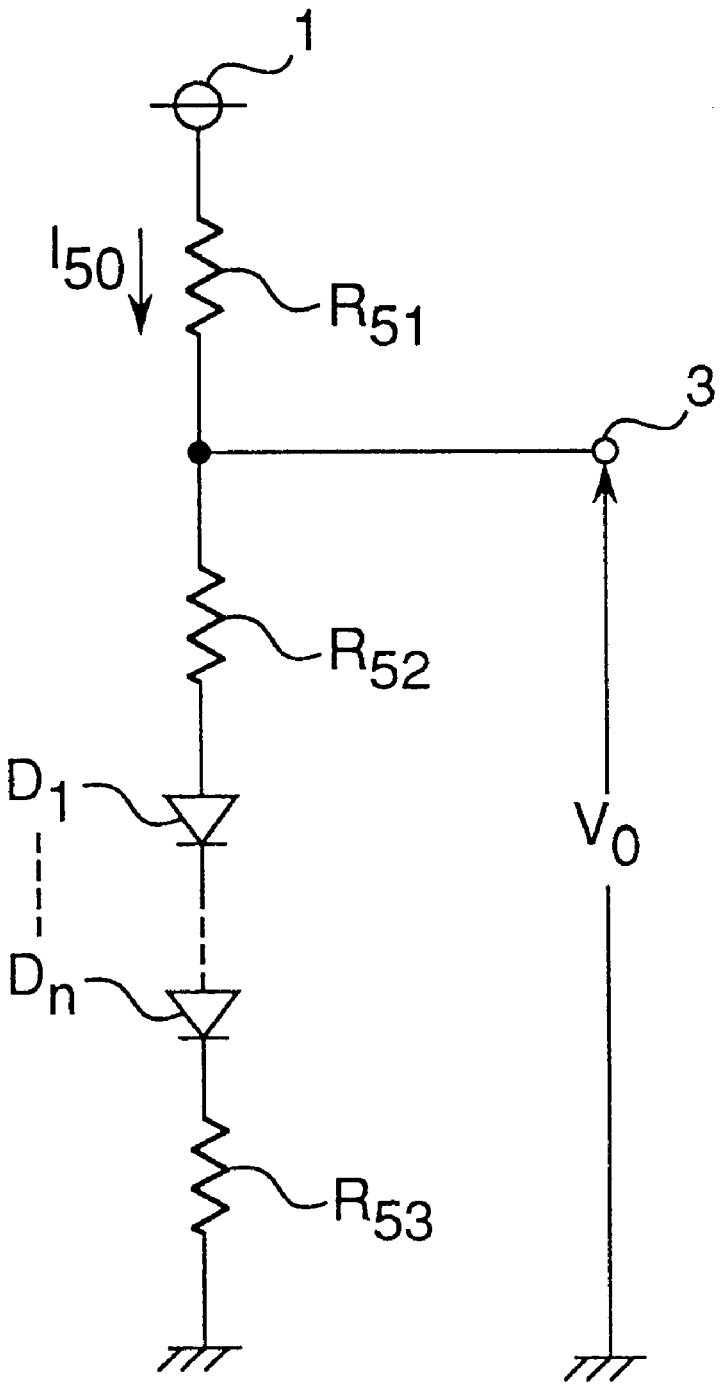
Fig.1 PRIOR ART
FIG. 1 is a circuit diagram of a conventional reference voltage generating circuit.
Figure 2:
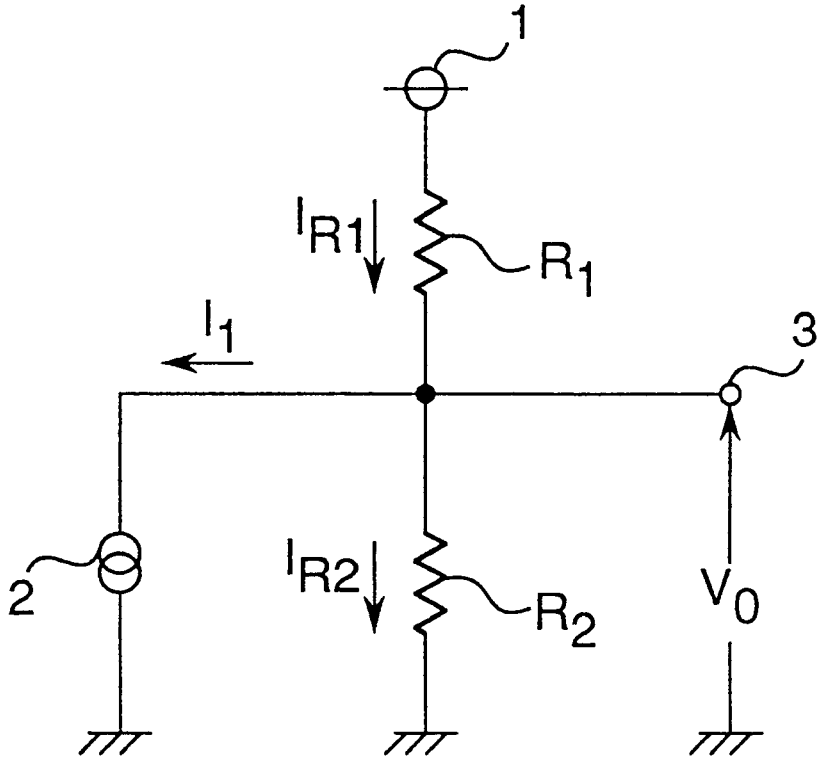
FIG. 2 is a diagram of a reference voltage generating circuit according to the first embodiment of the present invention.

FIG. 2 shows a reference voltage generating circuit according to a first embodiment of the present invention. As shown in FIG. 2, resistors $R_1$ and $R_2$ forming the voltage divider circuit are connected in series between the ground and the constant-voltage power supply 1 outputting a constant voltage $V_{cc}$. The constant-current source 2 is connected between the ground and the voltage divider junction, which is the connection between the resistors $R_1$ and $R_2$. The constant-current source 2 varies linearly with a desired temperature characteristic the level of the current $I_1$ flowing to or from said voltage divider junction. An output terminal 3 is also connected to the voltage divider junction, and the reference voltage $V_0$ is output from between the output terminal 3 and the ground.

If $V_{cc}$ is the voltage of the constant-voltage power supply 1, $I_{R1}$ is the current flowing through resistor $R_1$, $I_1$ is the current input to or from the voltage divider junction by the constant-current source 2, $I_{R2}$ is the current flowing through resistor $R_2$, and $V_0$ is the reference voltage output from the output terminal 3 and ground, then $I_{R1}=I_1+I_{R2}$, $V_{cc}=I_{R1}R_1+I_{R2}R_2$, and $V_0=I_{R2}R_2$. If $I_{R1}$ and $I_{R2}$ are eliminated from these three Equations, the following Equation (3) is obtained.

$$V_0=R_2V_{cc}/(R_1+R_2)-R_1R_2I_1/(R_1+R_2) \quad (3)$$

The temperature characteristic ($\partial V_0/\partial T$) expressed by Equation (4) below is obtained from Equation (3).

$$\partial V_0/\partial T=-R_1R_2/(R_2+R_3)\times\partial I_1/\partial T \quad (4)$$

As described above, because the constant-current source 2 varies linearly with a desired value the temperature characteristic ($\partial I_1/\partial T$) of the current $I_1$ flowing to or from the voltage divider junction, the temperature coefficient of the reference voltage $V_0$ output from the output terminal 3 can also be varied linearly with a desired temperature coefficient as shown by Equation (4).

Figure 3:
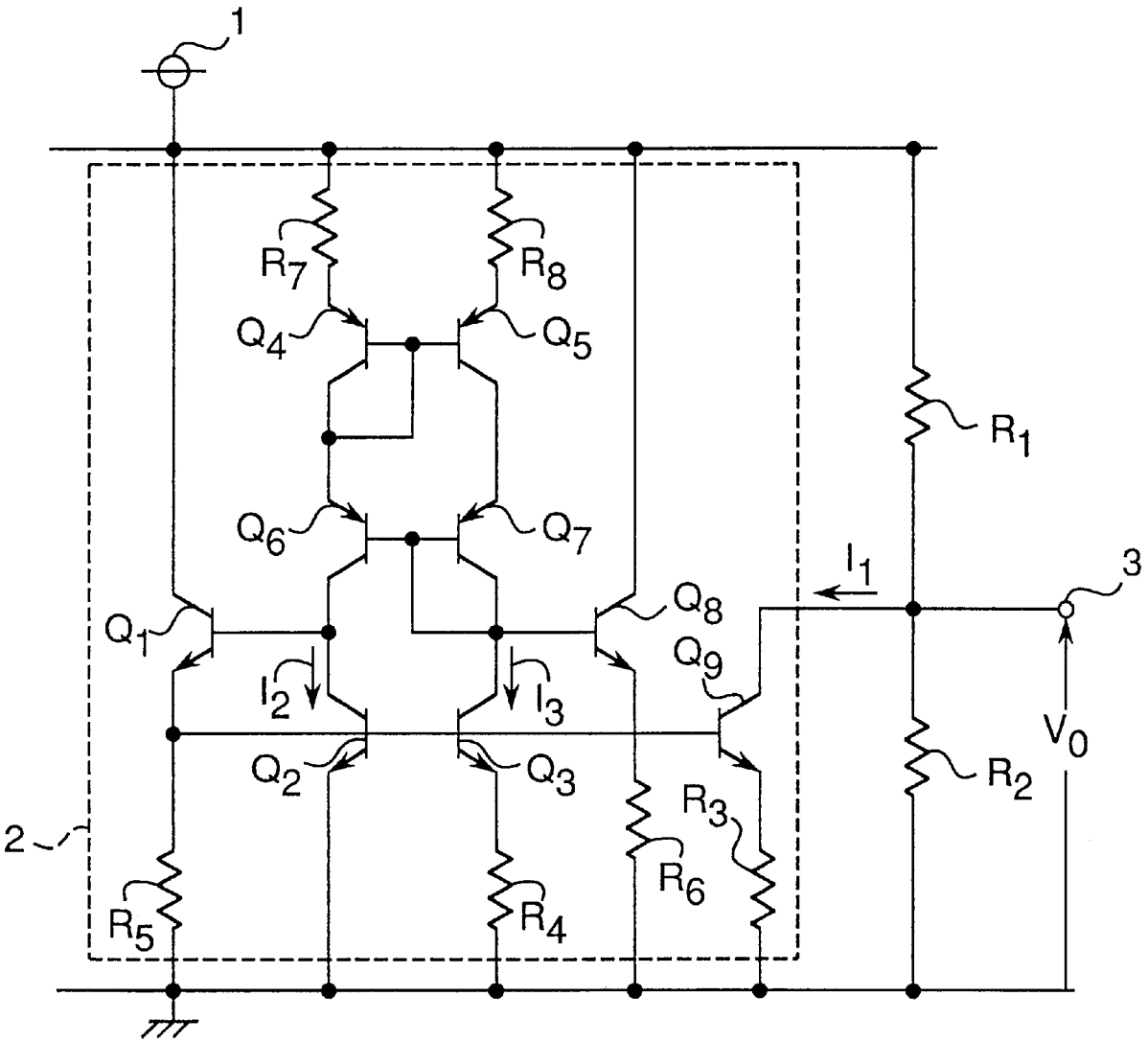
FIG. 3 is a circuit diagram of a reference voltage generating circuit generating a reference voltage having a negative temperature characteristic according to the second embodiment of the present invention.

Another embodiment of a reference voltage generating circuit according to the present invention is shown in FIG. 3. Note that like parts are identified by the same reference numerals in FIGS. 2 and 3, and duplicated description is therefore omitted. In the reference voltage generating circuit shown in FIG. 3, the constant-current source 2 is an integrated circuit comprising resistors $R_3$ through $R_8$, and bipolar transistors (simply "transistors" below) $Q_1$ through $Q_9$. In addition, resistors $R_7$ and $R_8$, and pnp-type transistors $Q_4$ through $Q_7$ form a current mirror circuit wherein the current $I_2$ flowing from the collector (first current path) of the pnp-type transistor $Q_6$, and the current $I_3$ flowing from the collector (second current path) of the pnp-type transistor $Q_7$, are always equal ($I_2=I_3$) even when the voltage $V_{cc}$ of the constant-voltage power supply 1 changes.

Resistor $R_7$ is connected between the emitter of transistor $Q_4$ and the constant-voltage power supply 1. The collector of transistor $Q_4$ is connected with the emitter of transistor $Q_6$, and the collector of transistor $Q_6$ is connected to the collector of transistor $Q_2$.

Resistor $R_8$ is connected between the emitter of transistor $Q_5$ and the constant-voltage power supply 1. The collector of transistor $Q_5$ is connected with the emitter of transistor $Q_7$, and the collector of transistor $Q_7$ is connected to the collector of transistor $Q_3$.

The collector of transistor $Q_4$ is also connected to the base of transistor $Q_4$ and the base of transistor $Q_5$, and the collector of transistor $Q_7$ is also connected to the base of transistor $Q_6$ and the base of transistor $Q_7$.

The emitter of transistor $Q_2$ is connected directly to ground. Resistor $R_4$ is connected between the emitter of transistor $Q_3$ and ground. The bases of transistors $Q_2$, $Q_3$, and $Q_9$ are all connected to the emitter of transistor $Q_1$. Resistor $R_5$ is connected between the emitter of transistor $Q_1$ and ground. Transistor $Q_1$ compensates the base current of transistors $Q_2$ and $Q_3$ to improve the precision of constant-current generation by the transistors $Q_2$ and $Q_3$.

The base of transistor $Q_8$ is also connected to the collector of transistor $Q_3$. Transistor $Q_8$ comprises a circuit for activating the constant-current source 2 with the collector of transistor $Q_8$ connected to the constant-voltage power supply 1, and a resistor $R_6$ connected between the emitter thereof and ground. A resistor $R_3$ is connected between the emitter of the transistor $Q_9$ and ground, and the collector of transistor $Q_9$ is connected to the junction (voltage divider junction) between resistor $R_1$ and resistor $R_2$. Transistor $Q_9$ and resistor $R_3$ are part of the integrated circuit, and have the same transistor size and resistance as transistor $Q_3$ and resistor $R_4$.

In the reference voltage generating circuit shown in FIG. 3, the reference voltage $V_0$ output from between the ground and the output terminal 3 can be obtained as follows. Equation (5) shown below is obtained where $V_{BE2}$ is the voltage between the base and emitter of the transistor $Q_2$, $V_{BE3}$ is the voltage between the base and emitter of the transistor $Q_3$, and $V_{R4}$ is the voltage drop in resistor $R_4$.

$$V_{BE2}=V_{BE3}+V_{R4} \tag{5}$$

If the emitter size ratio of transistors $Q_2$ and $Q_3$ is 1:N, the saturation current of transistor $Q_2$ is $I_S$, and $V_T$=kT/q (where q is the electron charge, k is Boltzmann's constant, and T is the absolute temperature), the base-emitter voltage $V_{BE2}$ of transistor $Q_2$ is expressed as $V_{BE2}=V_T 1n(I_2/I_s)$ based on Shockley's Equation, and the base-emitter voltage $V_{BE3}$ of transistor $Q_3$ is expressed as $V_{BE3}=V_T 1n(I_3/NI_s)$. By substituting these values into Equation (5), the following Equation (6) is obtained because $I_2=I_3$.

$$V_{R4}=V_T 1n(N) \tag{6}$$

From Equation (6), $I_2=I_3$ can be expressed by the following Equation (7).

$$\begin{aligned} I_2=I_3&=V_{R4}/R_4 \\ &=(V_T/R_4)1n(N) \end{aligned} \tag{7}$$

Because $V_T$=kT/q, $V_T$ is proportional to the absolute temperature T, currents $I_2$ and $I_3$ are therefore also proportional to the absolute temperature T based on Equation (7). Because transistor $Q_9$ and resistor $R_3$ have the same transistor size and resistance as transistor $Q_3$ and resistor $R_4$ in the integrated circuit, the collector current $I_1$ of transistor $Q_9$ has the relationship $I_1=I_2=I_3$, is proportional to the absolute temperature T, and is expressed by the following Equation (8).

$$\begin{aligned} I_1&=V_{R4}/R_4 \\ &=(V_T/R_4)1n(N) \\ &=(kT/qR_4)1n(N) \end{aligned} \tag{8}$$

From Equation (8), the reference voltage $V_0$ output from the output terminal 3 of the reference voltage generating circuit in FIG. 3 can be expressed by the following Equation (9).

$$\begin{aligned} V_0&=R_2V_{cc}/(R_1+R_2)-R_1R_2I_1/(R_1+R_2) \\ &=R_2V_{cc}/(R_1+R_2)-(kT/qR_4)1n(N)R_1R_2/(R_1+R_2) \end{aligned} \tag{9}$$

Therefore, the temperature characteristic ($\partial V_0/\partial T$) of the reference voltage $V_0$ output from the output terminal 3 can be expressed by the following Equation (10).

$$\partial V_0/\partial T=-(k/qR_4)1n(N)R_1R_2/(R_1+R_2)(=\text{constant}) \tag{10}$$

As shown by Equation (10), the temperature characteristic ($\partial V_0/\partial T$) of the reference voltage $V_0$ is inversely proportional to resistor $R_4$, and reference voltage $V_0$ varies linearly with a negative temperature coefficient to the absolute temperature T. Thus, the reference voltage $V_0$ can be varied linearly relative to the temperature with a desired negative temperature coefficient by selecting resistor $R_4$.

It is to be noted that a reference voltage generating circuit operating identically to that described above can be achieved by shorting resistor $R_3$ connected between the ground and the emitter of transistor $Q_9$ in FIG. 2, and making transistor $Q_9$ the same size as transistor $Q_2$ in the above embodiment.

Figure 4:
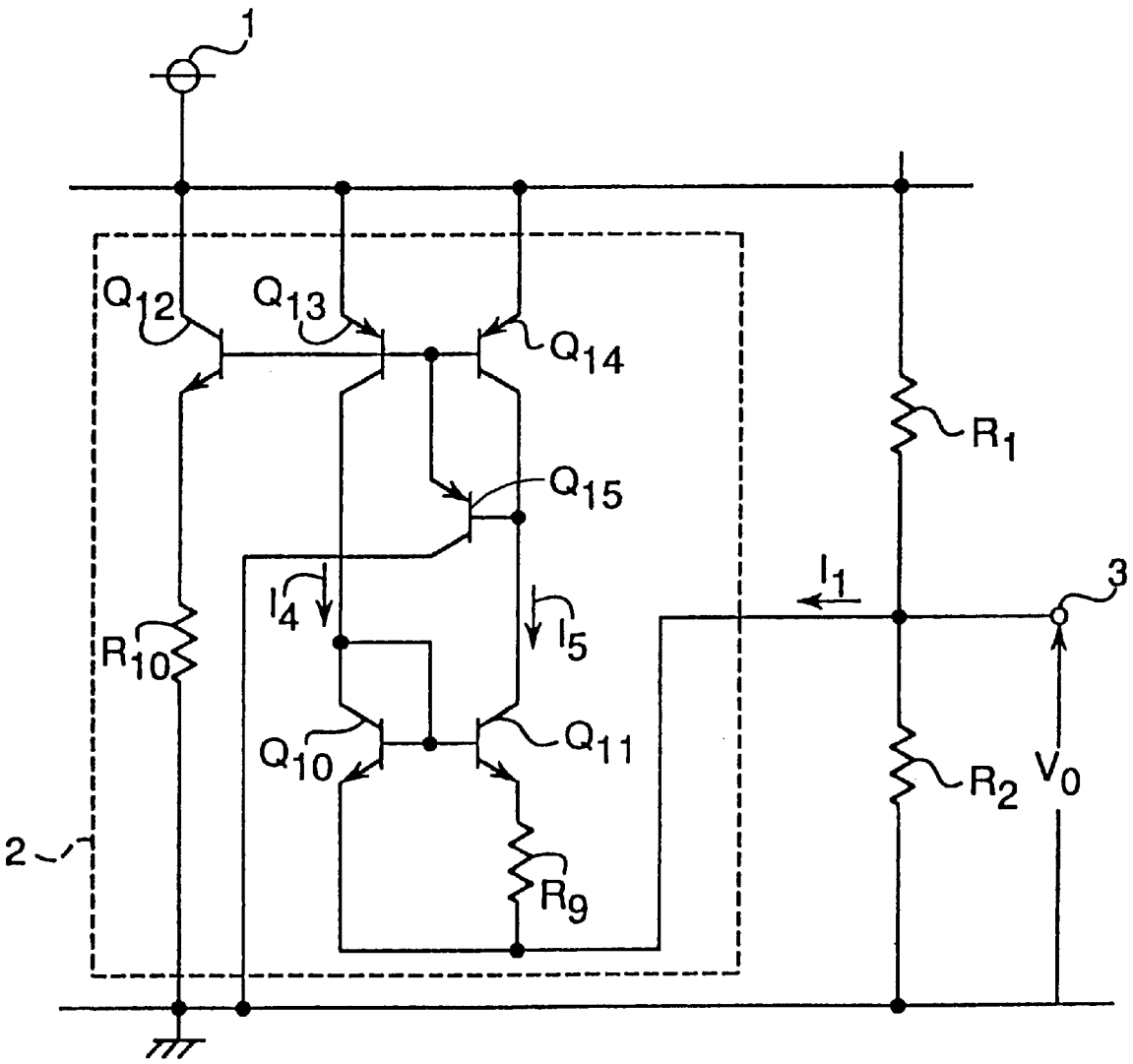
FIG. 4 is a circuit diagram of a reference voltage generating circuit generating a reference voltage having a negative temperature characteristic according to the third embodiment of the present invention.

A third embodiment of a reference voltage generating circuit according to the present invention is shown in FIG. 4. Note that like parts are identified by like reference numerals in FIGS. 2 and 4, and duplicated description is therefore omitted. In the reference voltage generating circuit, the constant-current source 2 is an integrated circuit comprising resistors $R_9$ and $R_{10}$, npn-type transistors $Q_{10}$, $Q_{11}$, and $Q_{12}$, and pnp-type transistors $Q_{13}$, $Q_{14}$, and $Q_{15}$. Transistors $Q_{13}$, $Q_{14}$, and $Q_{15}$ form a current mirror circuit constituted such that the current $I_4$ flowing to the collector of transistor $Q_{10}$, and the current $I_5$ flowing to the collector of transistor $Q_{11}$, are always equal ($I_4=I_5$) even when the voltage $V_{cc}$ of the constant-voltage power supply 1 changes. In addition, resistor $R_{10}$ and transistor $Q_{12}$ constitute a starting circuit for activating the current mirror circuit. The emitter of transistor $Q_{13}$ is connected to the constant-voltage power supply 1, and the collector thereof is connected to the collector of transistor $Q_{10}$. The emitter of transistor $Q_{14}$ is connected to the constant-voltage power supply 1, and the collector thereof is connected to the collector of transistor $Q_{11}$. The base of transistor $Q_{13}$ and the base of transistor $Q_{14}$ are mutually connected, and the collector of transistor $Q_{10}$ is connected to the base of transistor $Q_{10}$ and the base of transistor $Q_{11}$. The emitter of transistor $Q_{15}$ is connected to the base of both transistors $Q_{13}$ and $Q_{14}$, the base of transistor $Q_{15}$ is connected to the collector of transistor $Q_{14}$, and the collector of transistor $Q_{15}$ is connected to the ground. In addition, resistor $R_{10}$ is connected between the ground and the emitter of transistor $Q_{12}$, the base of transistor $Q_{12}$ is connected to the emitter of transistor $Q_{15}$, and the collector of transistor $Q_{12}$ is connected to the constant-voltage power supply 1.

The emitter of transistor $Q_{10}$ is connected to the voltage divider junction of resistors $R_1$ and $R_2$ forming the voltage divider circuit. Resistor $R_9$ is also connected between the voltage divider junction and the emitter of transistor $Q_{11}$.

In the reference voltage generating circuit shown in FIG. 4, reference voltage $V_0$ output from between the ground and the output terminal 3 can be obtained as follows. Equation (11) given below is obtained where $V_{BE10}$ is the voltage between the base and emitter of the transistor $Q_{10}$, $V_{BE11}$ is the voltage between the base and emitter of the transistor $Q_{11}$, and $V_{R9}$ is the voltage drop of resistor $R_9$ in the reference voltage generating circuit shown in FIG. 4.

$$V_{BE10}=V_{BE11}+V_{R9} \tag{11}$$

If the emitter size ratio of transistors $Q_{10}$ and $Q_{11}$ is 1:N, the saturation current of transistor $Q_{10}$ is $I_S$, and $V_T$=kT/q (where q is the electron charge, k is Boltzmann's constant, and T is the absolute temperature), the base-emitter voltage $V_{BE10}$ of transistor $Q_{10}$ is expressed as $V_{BE10}=V_T 1n(I_4/I_s)$ based on Shockley's Equation, and the base-emitter voltage $V_{BE11}$ of transistor $Q_{11}$ is expressed as $V_{BE11}=V_T 1n(I_{11}/NI_s)$. By substituting these values into Equation (11), the following Equation (12) is obtained because $I_4=I_5$.

$$V_{R9}=V_T 1n(N) \tag{12}$$

From Equation (12), $I_4=I_5$ can be expressed by the following Equation (13).

$$I_4=I_5=V_{R9}/R_9$$
$$=(V_T/R_9)1n(N) \quad (13)$$

However, because the current $I_1$ input to the voltage divider junction of resistors $R_1$ and $R_2$ is the sum of current $I_4$ and current $I_5$, $I_1=-(I_4+I_5)$, and current $I_1$ can be expressed by Equation (14) based on Equation (13).

$$I_1=-2(V_T/R_9)1n(N) \quad (14)$$

From Equation (14), the reference voltage $V_0$ output from the output terminal 3 of the reference voltage generating circuit in FIG. 4 can be expressed by the following Equation (15).

$$V_0=R_2V_{cc}/(R_1+R_2)-R_1R_2I_1/(R_1+R_2)$$
$$=R_2V_{cc}/(R_1+R_2)+2(kt/qR_9)1n(N)R_1R_2/(R_1+R_2) \quad (15)$$

Therefore, the temperature characteristic ($\partial V_0/\partial T$) of the reference voltage $V_0$ output from the output terminal 3 can be expressed by the following Equation (16).

$$\partial V_0/\partial T=2(kt/qR_9)1n(N)R_1R_2/(R_1+R_2)(=\text{constant}) \quad (16)$$

As shown by Equation (16), the temperature characteristic ($\partial V_0/\partial T$) of the reference voltage $V_0$ is inversely proportional to the value of resistor $R_9$, and reference voltage $V_0$ varies linearly with a positive temperature coefficient to the absolute temperature T. Thus, the reference voltage $V_0$ can be varied linearly relative to the temperature with a desired positive temperature coefficient by selecting resistor $R_9$.

Figure 5:
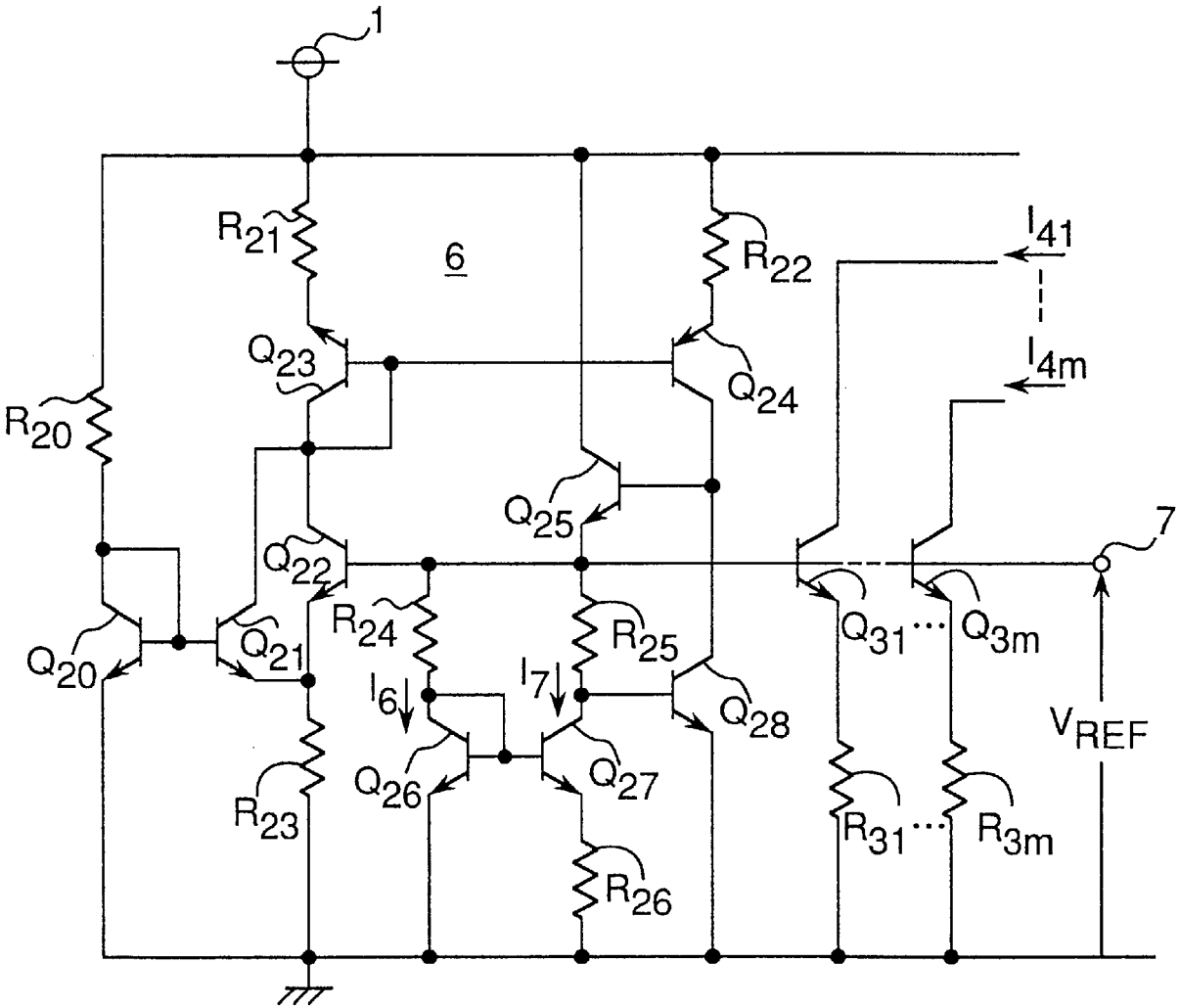
FIG. 5 is a circuit diagram of the constant-current source used in the reference voltage generating circuit according to the fourth embodiment of the present invention.
Figure 6:
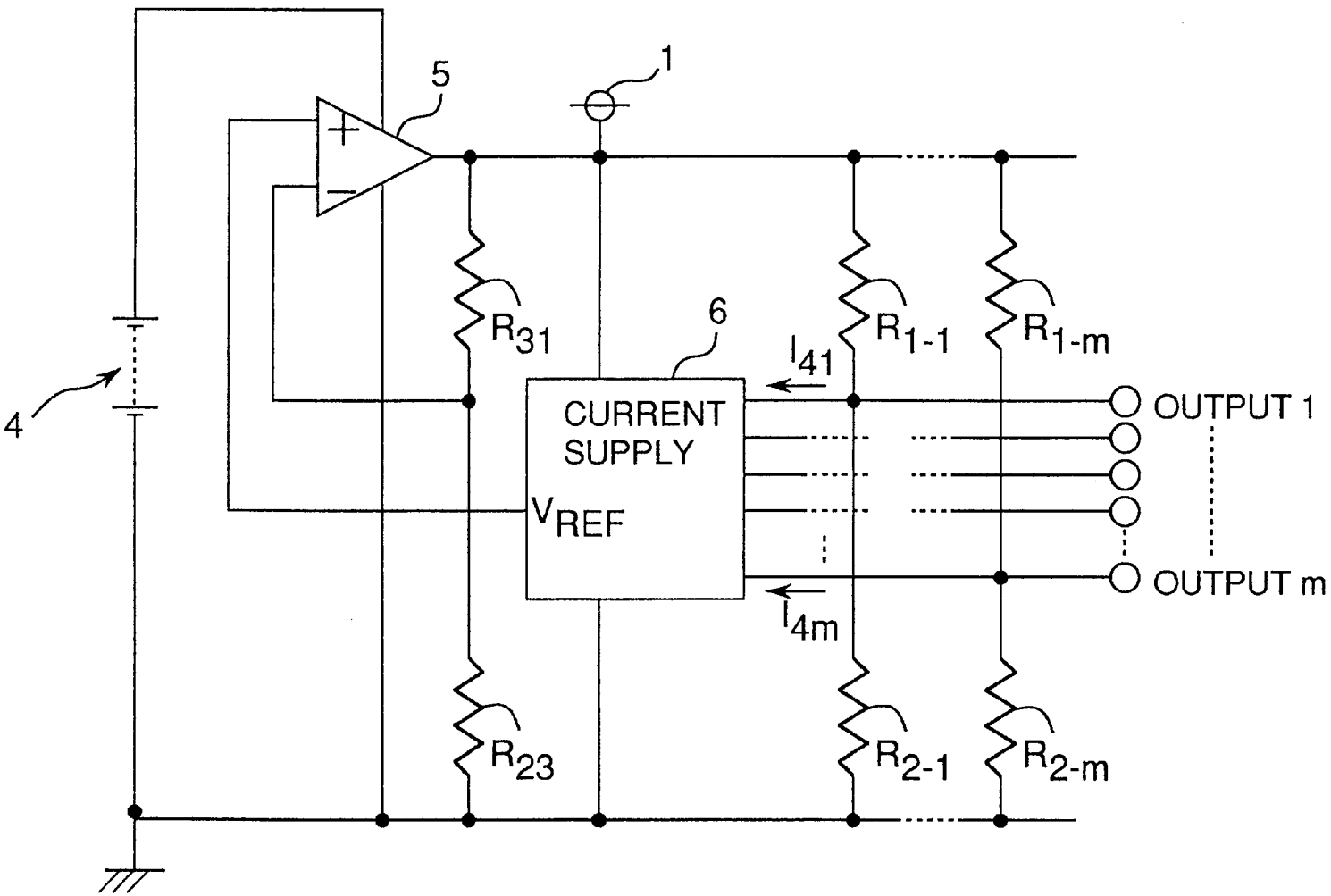
FIG. 6 is a circuit diagram of the reference voltage generating circuit according to the fourth embodiment of the present invention comprising the constant-current source shown in FIG. 4 for generating plural reference voltages.

A fourth embodiment of a reference voltage generating circuit according to the present invention is shown in FIGS. 5 and 6. This embodiment is a circuit for generating plural reference voltages; FIG. 5 shows the integrated constant-current supply circuit 6 for generating constant-currents $I_{41}$ through $I_{4m}$, and FIG. 6 shows the specific circuitry of a reference voltage generating circuit comprising the constant-current supply circuit 6. The constant-current supply circuit 6 in FIG. 5 comprises resistors $R_{20}$through $R_{26}$, resistors $R_{31}$ through $R_{3m}$, transistors $Q_{20}$ through $Q_{28}$, and transistors $Q_{31}$ through $Q_{3m}$. Transistors $Q_{23}$ and $Q_{24}$, and resistors $R_{21}$ and $R_{22}$ form a current mirror circuit constituted such that the collector current of transistor $Q_{22}$ and the collector current of transistor $Q_{28}$ are always equal even when the voltage $V_{cc}$ of the constant-voltage power supply 1 changes. In addition, resistors $R_{24}$ and $R_{25}$ maintain a constant ratio between the collector currents of transistors $Q_{26}$ and $Q_{27}$. Resistor $R_{21}$ is connected between the emitter of transistor $Q_{23}$ and the constant-voltage power supply 1. The collector of transistor $Q_{23}$ and the collector of transistor $Q_{22}$ are mutually connected, and resistor $R_{23}$ is connected between ground and the emitter of transistor $Q_{22}$. Resistor $R_{22}$ is connected between the emitter of transistor $Q_{24}$ and the constant-voltage power supply 1. The collector of transistor $Q_{24}$ and the collector of transistor $Q_{28}$ are mutually connected, and the emitter of transistor $Q_{28}$ is connected to ground. The collector of transistor $Q_{22}$ is connected to the base of transistor $Q_{23}$ and the base of transistor $Q_{24}$.

The base of transistor $Q_{25}$ is connected to the collector of transistor $Q_{24}$, and the collector of transistor $Q_{25}$ is connected to the constant-voltage power supply 1. The emitter of transistor $Q_{25}$ is connected to the base of transistor $Q_{22}$, and to the bases of transistors $Q_{31}$ through $Q_{3m}$. The emitter of transistor $Q_{26}$ is connected to ground, and resistor $R_{24}$ is connected between the collector of transistor $Q_{26}$ and the emitter of transistor $Q_{25}$. Resistor $R_{26}$ is connected between ground and the emitter of transistor $Q_{27}$, and resistor $R_{25}$ is connected between the collector of transistor $Q_{27}$ and the emitter of transistor $Q_{25}$. The collector and emitter of transistor $Q_{26}$ are mutually connected. The base of transistor $Q_{20}$ and the base of transistor $Q_{21}$ are mutually connected. The base and collector of transistor $Q_{20}$ are mutually connected, the emitter thereof is connected to ground, and resistor $R_{20}$ is connected between the collector of transistor $Q_{20}$ and the constant-voltage power supply 1. The emitter of transistor $Q_{21}$ is connected to the emitter of transistor $Q_{22}$, and the collector thereof is connected to the collector of transistor $Q_{22}$.

The base of each of transistors $Q_{31}$ through $Q_{3m}$ is connected to the emitter of transistor $Q_{25}$, and resistors $R_{31}$ through $R_{3m}$ are respectively connected between ground and the emitter of each of transistors $Q_{31}$ through $Q_{3m}$. The reference voltage output terminal 7 outputting the reference voltage $V_{REF}$ is connected to the emitter of transistor $Q_{25}$.

In the reference voltage generating circuit shown in FIG. 5, currents $I_{41}$ through $I_{4m}$ flowing to the corresponding collectors of transistors $Q_{31}$ through $Q_{3m}$ can be obtained as described below. Because the collector current ratio of transistors $Q_{26}$ and $Q_{27}$ is determined by resistors $R_{24}$ and $R_{25}$ as already described, the collector current $I_6$ of transistor $Q_{26}$ and the collector current $I_7$ of transistor $Q_{27}$ will become equal if the base current of transistor $Q_{28}$ is ignored when the values of resistor $R_{24}$ and resistor $R_{25}$ are equal.

Equation (17) given below is obtained where $V_{BE26}$ is the voltage between the base and emitter of the transistor $Q_{26}$, $V_{BE27}$ is the voltage between the base and emitter of transistor $Q_{27}$, and $V_{R26}$ is the voltage drop in resistor $R_{26}$ of the circuit shown in FIG. 5.

$$V_{BE26}=V_{BE27}+V_{R26} \quad (17)$$

If the emitter size ratio of transistors $Q_{26}$ and $Q_{27}$ is 1:N, the saturation current of transistor $Q_{26}$ is $I_S$, and $V_T=kT/q$ (where q is the electron charge, k is Boltzmann's constant, and T is the absolute temperature), the base-emitter voltage $V_{BE26}$ of transistor $Q_{26}$ is expressed as $V_{BE26}=V_T1n(I_6/I_s)$ based on Shockley's Equation, and the base-emitter voltage $V_{BE27}$ of transistor $Q_{27}$ is expressed as $V_{BE27}=V_T1n(I_7/NI_s)$. By substituting these values into Equation (17), the following Equation (18) is obtained because $I_6=I_7$.

$$V_{R26}=V_T1n(N) \quad (18)$$

From Equation (18), $I_6=I_7$ can be expressed by the following Equation (19).

$$I_6=I_7=V_{R26}/R_{26}$$
$$=(V_T/R_{26})1n(N) \quad (19)$$

Because $V_T=kT/q$, $V_T$ is proportional to the absolute temperature T, currents $I_6$ and $I_7$ are therefore also proportional to the absolute temperature T based on Equation (19). If transistor $Q_{22}$ and resistor $R_{23}$ are made from the same devices as transistor $Q_{26}$ and resistor $R_{24}$, the current input to transistor $Q_{22}$ will be equal to the current $I_6$ described above. Similarly, if transistors $Q_{31}$ through $Q_{3m}$ and resistors $R_{31}$ through $R_{3m}$ are likewise made from the same devices as transistor $Q_{26}$ and resistor $R_{24}$, $I_{41}= \ldots I_{4m}=I_6$. It is therefore known that currents $I_{41}$ through $I_{4m}$ also vary proportionally to the absolute temperature T.

The reference voltage $V_{REF}$ (expressed as $V_{BG}$) output from the reference voltage output terminal 7 is the sum of the base-emitter forward voltage drop $V_{BE28}$ of transistor $Q_{28}$ and the voltage drop of resistor $R_{25}$, and is obtained by Equation (20) below.

$$V_{BE}=V_{BE28}+R_{25}I_7$$
$$=V_{BE28}+(R_{25}V_T/R_{26})1n(N) \quad (20)$$

The temperature characteristic of $V_{BG}$ will be zero (0) if the circuit constant is set so that the temperature characteristic of the base-emitter forward voltage drop $V_{BE28}$ of transistor $Q_{28}$ and the temperature characteristic of $(R_{25}V_T/R_{26})1n(N)$ are mutually canceling. In this case, a reference voltage $V_{REF}$ with a temperature characteristic of zero can be obtained from the reference voltage output terminal 7. It is to be noted that when the temperature characteristic of $V_{BG}$ in the circuit in FIG. 5 is zero (0), $V_{BG}$ is called the band gap voltage, and is usually 1.25 volts.

As shown in FIG. 6, the constant-current supply circuit 6 described above and resistors $R_{31}$ and $R_{32}$ are connected between the ground and the output terminal of the operational amplifier 5 comprising the constant-voltage power supply 1, which stabilizes and outputs the unstabilized power supply voltage of the power supply 4. The reference voltage $V_{REF}$ generated by the constant-current supply circuit 6 is supplied to the noninverting input of the operational amplifier 5, and is connected to the voltage divider junction of voltage divider resistors $R_{31}$ and $R_{23}$ serially connected between ground and the output terminal of the operational amplifier 5. The collectors (see FIG. 5) of the transistors $Q_{31}$ through $Q_{3m}$ of the constant-current supply circuit 6 are respectively connected to the voltage divider junction of voltage divider resistors $R_{1-1}$ and $R_{2-1}$, and voltage divider resistors $R_{1-m}$ and $R_{2-m}$, serially connected between the ground and the output terminal of the operational amplifier 5. By using the constant-current supply circuit 6 in FIG. 5, it is possible to generate plural reference voltages each having a temperature characteristic varying linearly relative to temperature by simply combining the operational amplifier 5 with the constant-current supply circuit 6, and without using Zener diodes or other devices generating the reference voltage $V_{REF}$. It is also possible by means of the circuitry of the constant-current supply 6 to increase the voltage drop generated at the resistors $R_{31}$ through $R_{3m}$ determining the constant-current value, and this circuitry is suited to constituting plural constant-current supplies because error in the constant-current value caused by degraded relativity between transistor $Q_{22}$ and the npn-type transistors $Q_{31}$ through $Q_{3m}$ can be reduced.

An advantage of the present invention is that a reference voltage varying linearly with a desired temperature coefficient can be obtained from the voltage divider junction of the voltage divider circuit because the constant-current source linearly varies the current level flowing to or from the voltage divider junction of the voltage divider circuit with a desired temperature coefficient.

Another advantage of the present invention is that a reference voltage varying linearly with a desired negative temperature coefficient can be obtained from the voltage divider junction of the voltage divider circuit because the constant-current source varies the current obtained from the voltage divider junction of the voltage divider circuit linearly with respect to temperature with a desired temperature coefficient.

A further advantage of the invention is that a reference voltage varying linearly with a desired negative temperature coefficient can be obtained from the voltage divider junction of the voltage divider circuit by selecting the value of the resistor connected to the emitter of the second transistor because the current flowing from the voltage divider junction of the voltage divider circuit is proportional to temperature and inversely proportional to the value of the resistor connected to the emitter of the second transistor.

A still further advantage of the present invention is that a reference voltage varying linearly with a desired positive temperature coefficient can be obtained from the voltage divider junction of the voltage divider circuit because the constant-current source varies the current input to the voltage divider junction of the voltage divider circuit linearly with respect to temperature with a desired temperature coefficient.

A still further advantage of the present invention is that a reference voltage varying linearly with a desired positive temperature coefficient can be obtained from the voltage divider junction of the voltage divider circuit by selecting the value of the resistor connected to the emitter of the second transistor because the current extracting transistor functions to input to the voltage divider junction of the resistor-type voltage dividing circuit a current proportional to temperature and inversely proportional to the value of the resistor connected to the emitter of the second transistor connected to the second current path of the first and second current paths of the current mirror circuit.

A still further advantage of the present invention is that plural reference voltages each varying linearly with a desired negative temperature coefficient can be obtained from the voltage divider junction of each voltage divider circuit by selecting the value of a first resistor because the current extracting transistor functions to extract from each voltage divider junction of plural voltage divider circuits a current proportional to temperature and inversely proportional to the value of the first resistor, which is connected between the other output terminal of the constant-voltage power supply and the emitter of the second transistor of which the base is connected to the base and the collector of a first transistor of which the emitter is connected to the other output terminal of the constant-voltage power supply.

Because a standard voltage with a temperature characteristic of zero is output from the emitter of a fifth transistor, this standard voltage can be used as the standard voltage of the constant-voltage power supply.

Because an operational amplifier controls its output voltage to maintain a constant difference between said output voltage and the standard voltage, the operational amplifier functions as the constant-voltage power supply for connecting the constant-current source, and the reference voltage generating circuit can be simply constituted.

Because the thermal coupling between components is improved and thermal response is also improved by constituting the constant-current source by means of an integrated circuit, charging optimized to the temperature of the battery can be achieved by inclusion in the battery charging apparatus.

Although the present invention has been described in relation to particular embodiments and other uses will become apparent to those skilled in the art. It is preferred, therefore, that the present invention be limited not by the specific disclosure herein, but only by the appended claims.

What is claimed is:

1. A reference voltage generating circuit for generating a reference voltage that changes linearly with temperature, the reference voltage generating circuit comprising:

a constant-voltage power supply for outputting a constant voltage and having first and second output terminals;

a voltage divider circuit connected between the first and second output terminals; and a constant-current source connected to a voltage divider junction of said voltage divider circuit for linearly changing with temperature current flowing into or out of the voltage divider junction, a reference voltage being output from said voltage divider junction, said constant-current source including a current mirror circuit comprising:

a first current path and a second current path established by a connection to the second output terminal for equalizing respective currents flowing through the first and second current paths, a first transistor having a base and connected between the first current path and the second output terminal, a second transistor having an emitter and a collector, the collector being connected in the second current path, a resistor having a resistance and connected between the emitter of said second transistor and the second output terminal, and a current extracting transistor having a base connected to the base of said first transistor and to the base of said second transistor, and a collector connected to the voltage divider junction, for sensing current flow at the voltage divider junction, wherein a current flow inversely proportional to the resistance of said resistor and proportional to temperature is obtained at the voltage divider junction.

2. The reference voltage generating circuit according to claim 1, wherein the reference voltage changes inversely with temperature changes.

3. The reference voltage generating circuit according to claim 1, wherein said constant-current source comprises an integrated circuit.

4. The reference voltage generating circuit according to claim 5, wherein the reference voltage changes directly with temperature changes.

5. A reference voltage generating circuit for generating a reference voltage that changes linearly with temperature, the reference voltage generating circuit comprising:

a constant-voltage power supply for outputting a constant voltage and having first and second output terminals;

a voltage divider circuit connected between the first and second output terminals; and a constant-current source connected to a voltage divider junction of said voltage divider circuit for linearly changing with temperature current flowing into or out of the voltage divider junction, a reference voltage being output from said voltage divider junction, said constant-current source including a current mirror circuit comprising:

a first current path and a second current path established by a connection to the first output terminal for equalizing currents flowing through the first and second current paths, a first transistor connected between the first current path and the voltage divider junction, a second transistor having an emitter and a collector, the collector being connected in the second current path, and a resistor having a resistance and connected between the emitter of said second transistor and the voltage divider junction, wherein a current flow inversely proportional to the resistance of the resistor and proportional to temperature is obtained at the voltage divider junction.

6. A reference voltage generating circuit for generating a reference voltage having a negative temperature coefficient, the reference voltage generating circuit comprising:

a constant-voltage power supply for outputting a constant voltage and having first and second terminals;

a plurality of voltage divider circuits connected between the first and second output terminals of the constant-voltage power supply; and a constant-current source, said constant-current including:

a current mirror circuit comprising a first current path and a second current path established by a connection with the second output terminal for equalizing currents flowing through the first and second current paths;

a first transistor having a base, a collector, and an emitter, the emitter being connected to the second output terminal of said constant-voltage power supply;

a second transistor having an emitter and a base, the base of said second transistor being connected to the base and the collector of said first transistor;

a first resistor having a resistance and connected between the emitter of said second transistor and the second output terminal;

a third transistor having an emitter and a collector, the collector of said third transistor being connected to the first current path;

a second resistor connected between the emitter of said third transistor and the second output terminal;

a fourth transistor having a collector and an emitter, the collector of the fourth transistor being connected in the second current path, and the emitter of said fourth transistor being connected to the second output terminal;

a fifth transistor having an emitter, a collector, and a base, the base of said fifth transistor being connected to the collector of said fourth transistor, the emitter of said fifth transistor being connected to the base of said third transistor, and the collector of said fifth transistor being connected to the first output terminal;

a third resistor connected between the emitter of said fifth transistor and the collector of said first transistor;

a fourth resistor connected between the emitter of said fifth transistor and the collector of said second transistor; and sixth transistors, each sixth transistor having a collector, an emitter, and a base, each base of said sixth transistors being connected to the emitter of said fifth transistor, each emitter of said sixth transistors of said sixth transistors being connected to the second output terminal, and each collector of said sixth transistors being connected to a voltage divider junction of a respective one of the voltage divider circuits, wherein a current inversely proportional to the resistance of said first resistor and proportional to temperature is obtained at the voltage divider junction.

7. The reference voltage generating circuit according to claim 6, wherein the emitter of said fifth transistor supplies a voltage that does not vary with temperature.

8. The reference voltage generating circuit according to claim 8 wherein the constant-voltage power supply comprises:

an operational amplifier having an input and an output, and a feedback resistor connected to the output of said operational amplifier to feedback changes in the output to the input, wherein said constant-current source and said voltage divider circuits are connected to the output of said operational amplifier, and the voltage output from said constant-current source is connected to the input of said operational amplifier.

9. The reference voltage generating circuit according to claim 8, wherein said constant-current source comprises integrated circuit.

10. A reference voltage generating circuit for generating a reference voltage that changes linearly with the temperature, the reference voltage generating circuit comprising:

a constant-voltage power supply for outputting a constant voltage and having first and second output terminals;

a voltage divider circuit connected between the first and second output terminals; and a constant-current source connected to a voltage divider junction of said voltage divider circuit for linearly changing with temperature current flowing into or out of said voltage divider junction, a reference voltage linearly changing with temperature being output from said voltage divider junction.

11. The reference voltage generating circuit according to claim 10, wherein the reference voltage changes inversely with temperature changes.

12. The reference voltage generating circuit according to claim 10, wherein said constant-current source comprises an integrated circuit.

* * * * *